US008347800B1

(12) United States Patent
Machell-Archer et al.

(10) Patent No.: US 8,347,800 B1
(45) Date of Patent: Jan. 8, 2013

(54) METHODS FOR TUFTING A CARPET PRODUCT

(75) Inventors: Carson Rebecca Machell-Archer, West Point, GA (US); Charles Chris Chapman, Lafayette, AL (US)

(73) Assignee: Interface, Inc., Atlanta, GA (US)

( * ) Notice: Subject to any disclaimer, the term of this patent is extended or adjusted under 35 U.S.C. 154(b) by 0 days.

(21) Appl. No.: 13/190,635

(22) Filed: Jul. 26, 2011

(51) Int. Cl.
*D05C 15/34* (2006.01)

(52) U.S. Cl. ..... 112/475.23

(58) Field of Classification Search ..... 112/410, 112/2.2, 80.23, 80.24, 80.01, 475.18, 475.19, 112/475.23; 700/136–138
See application file for complete search history.

(56) References Cited

U.S. PATENT DOCUMENTS 1,990,907 A * 2/1935 Kellogg ..... 112/80.71
1,997,869 A * 4/1935 Loos ..... 112/80.16
2,679,218 A * 5/1954 Jones ..... 112/80.31
2,784,689 A * 3/1957 MacCaffray, Jr. ..... 112/80.7
3,895,355 A * 7/1975 Shorrock ..... 700/90
4,047,491 A * 9/1977 Spanel et al. ..... 112/80.07
4,301,751 A * 11/1981 Caylor ..... 112/80.32
4,440,102 A 4/1984 Card et al.
4,559,885 A 12/1985 Card et al.
4,586,445 A 5/1986 Card et al.
4,587,914 A 5/1986 Card et al.
4,608,934 A 9/1986 Card et al.
4,619,212 A 10/1986 Card et al.
4,630,558 A 12/1986 Card et al.
4,665,845 A 5/1987 Card et al.
4,669,171 A 6/1987 Card et al.
4,688,497 A 8/1987 Card et al.
4,691,646 A 9/1987 Card et al.
4,693,191 A 9/1987 Card et al.
4,815,403 A 3/1989 Card et al.
4,836,118 A 6/1989 Card et al.
4,867,080 A 9/1989 Taylor et al.
4,903,624 A 2/1990 Card et al.
4,903,625 A 2/1990 Card et al.
4,981,091 A 1/1991 Taylor et al.
5,005,498 A 4/1991 Taylor et al.
5,058,518 A 10/1991 Card et al.
5,287,819 A 2/1994 Beatty et al.
5,295,450 A 3/1994 Neely
5,383,415 A * 1/1995 Padgett, III ..... 112/475.23
5,400,727 A 3/1995 Neely
5,499,588 A 3/1996 Card et al.
5,513,586 A 5/1996 Neely et al.
5,549,064 A * 8/1996 Padgett, III ..... 112/410
5,562,056 A 10/1996 Christman, Jr.
5,572,939 A 11/1996 Beatty
5,622,126 A 4/1997 Card et al.
5,706,744 A 1/1998 Card et al.
5,706,745 A 1/1998 Neely et al.
5,743,201 A 4/1998 Card et al.
5,857,422 A 1/1999 Neely et al.
5,896,821 A 4/1999 Neely et al.
5,979,344 A 11/1999 Christman, Jr.
5,983,815 A 11/1999 Card
6,009,818 A 1/2000 Card et al.

(Continued)

*Primary Examiner* — Danny Worrell
(74) *Attorney, Agent, or Firm* — Kilpatrick Townsend & Stockton LLP

(57) ABSTRACT

Methods of tufting a pattern in a backing material using a plurality of different yarns A, B, . . . n that are threaded in the needles of a needle bar in a non-repeating sequence or pattern of yarn sets across the width of the needle bar.

16 Claims, 1 Drawing Sheet

| Needle Position | 1 | 2 | 3 | 4 | 5 | 6 | 7 | 8 | 9 | 10 | 11 | 12 | 13 | 14 | 15 | 16 | 17 | 18 | ... |
|---|---|---|---|---|---|---|---|---|---|---|---|---|---|---|---|---|---|---|---|
| Yarn | A | G | J | B | F | J | B | F | I | B | F | I | A | H | I | B | F | I | ... |

U.S. PATENT DOCUMENTS

| | | | | |
|---|---|---|---|---|
| RE37,108 | E | 3/2001 | Neely | |
| 6,318,730 | B1 | 11/2001 | Neely | |
| 6,725,789 | B1 | 4/2004 | Hall | |
| 6,758,154 | B2 | 7/2004 | Johnston | |
| 6,807,917 | B1 | 10/2004 | Christman et al. | |
| 6,834,601 | B2 * | 12/2004 | Card et al. | 112/80.23 |
| 6,834,602 | B1 | 12/2004 | Hall | |
| 6,945,183 | B2 * | 9/2005 | Card et al. | 112/80.23 |
| 7,007,617 | B2 | 3/2006 | Johnston | |
| 7,096,806 | B2 | 8/2006 | Card et al. | |
| 7,216,598 | B1 | 5/2007 | Christman, Jr. | |
| 7,237,497 | B2 | 7/2007 | Johnston | |
| 7,284,492 | B2 | 10/2007 | Johnston | |
| 7,347,151 | B1 | 3/2008 | Johnston et al. | |
| 7,359,761 | B1 | 4/2008 | Christman, Jr. | |
| 7,398,739 | B2 | 7/2008 | Johnston | |
| 7,438,007 | B1 | 10/2008 | Hall | |
| 7,490,566 | B2 | 2/2009 | Hall | |
| 7,597,057 | B2 | 10/2009 | Johnston et al. | |
| 7,634,326 | B2 | 12/2009 | Christman, Jr. et al. | |
| 7,717,051 | B1 | 5/2010 | Hall et al. | |
| 7,739,970 | B2 | 6/2010 | Hall | |
| 7,814,850 | B2 * | 10/2010 | Bearden | 112/80.4 |
| 7,905,187 | B2 | 3/2011 | Card et al. | |
| 7,946,233 | B2 | 5/2011 | Hall et al. | |
| 7,997,219 | B2 | 8/2011 | Jackson | |
| 8,096,247 | B2 | 1/2012 | Monroe et al. | |
| 8,141,505 | B2 | 3/2012 | Hall et al. | |
| 8,141,506 | B2 | 3/2012 | Hall et al. | |
| 8,201,509 | B2 | 6/2012 | Christman, Jr. | |
| 2008/0264315 | A1 | 10/2008 | Neely | |
| 2009/0078180 | A1 | 3/2009 | Hall | |
| 2009/0101051 | A1 | 4/2009 | Christman, Jr. | |
| 2009/0205547 | A1 * | 8/2009 | Hall et al. | 112/80.41 |
| 2009/0220728 | A1 | 9/2009 | Hall et al. | |
| 2009/0260554 | A1 | 10/2009 | Hall et al. | |
| 2012/0174846 | A1 | 7/2012 | Hall et al. | |

* cited by examiner

| Needle Position | 1 | 2 | 3 | 4 | 5 | 6 | 7 | 8 | 9 | 10 | 11 | 12 | 13 | 14 | 15 | 16 | 17 | 18 | ... |
|---|---|---|---|---|---|---|---|---|---|---|---|---|---|---|---|---|---|---|---|
| Yarn | A | B | C | A | B | C | A | B | C | A | B | C | A | B | C | A | B | C | ... |

Fig. 1
(Prior Art)

| Needle Position | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | ... |
|---|---|---|---|---|---|---|---|---|---|---|---|---|---|---|---|---|---|---|---|---|---|---|---|---|---|
| Yarn | A | B | C | D | E | F | G | H | I | J | K | L | A | B | C | D | E | F | G | H | I | J | K | L | ... |

Fig. 2
(Prior Art)

| Needle Position | 1 | 2 | 3 | 4 | 5 | 6 | 7 | 8 | 9 | 10 | 11 | 12 | 13 | 14 | 15 | 16 | 17 | 18 | ... |
|---|---|---|---|---|---|---|---|---|---|---|---|---|---|---|---|---|---|---|---|
| Yarn | A | G | J | B | F | J | B | F | I | B | F | I | A | H | I | B | F | I | ... |

Fig. 3

METHODS FOR TUFTING A CARPET PRODUCT

FIELD

Embodiments of the present invention relate to improved methods for imparting diversity of color to a tufted carpet product.

BACKGROUND

Tufted carpet products bearing intricate patterns formed with a number of diverse colors are in high demand, particularly in industries such as the hospitality industry. U.S. Patent Publication No. 2009/0205547 to Hall et al. ("Hall"), the entirety of which is incorporated by reference, describes a tufting machine and related system for controlling the machine to form "free-flowing patterns." Hall discloses a needle bar with a plurality of needles arranged across the bar. A yarn is associated with each needle. A backing material is fed under the needle bar, which is reciprocated to drive the needles through and out of the backing material to form loops of yarn in the backing material.

If the needle bar did not move laterally relative to the backing and operated as described above, the resulting product would simply consist of yarn loops extending in lines of a single color along the length of the backing material. To form a pattern with the yarn loops, it is necessary for the needle bar to shift laterally to vary the positioning of the different color yarn loops on the backing material to form a design. Hall teaches a control system that is programmed with the desired pattern information and that controls operation of the machine, including shifting of the needle bar, to create a desired pattern in the final tufted product.

Hall teaches thread-up of the needle bar with a repeating pattern of yarn colors across the needle bar. Thus, if the desired product is to have three different yarn colors (A, B, and C), those three colors would be threaded-up in the same order or sequence across the entire needle bar (i.e., ABCABCABC, etc.), as shown in FIG. 1. Hall teaches this same thread-up methodology of a repeating sequence or pattern of the colors regardless of the number of different color yarns desired to be used. See, e.g., FIGS. 6A-D. The control system must be told how many different color yarns are being used so that it can adjust the shifting of the needle bar and speed of tufting accordingly, as discussed below.

The appearance of a yarn loop on the face of a tufted product can be controlled by controlling the height of that yarn loop. Where a yarn loop of a particular color is not to be readily visible at a particular location, that yarn loop is formed or tufted "low" in that location so that the surrounding tufted loops of a different color that are to be visible are higher and thus more prominent visibly.

Hall controls the visibility of yarn loops on a tufted product by controlling the tension placed on the yarn to either "pull low or backrob" a yarn loop. According to applicants understanding, to "pull low" the yarn loop is first tufted to a tuft height and then partially pulled back through the backing material so as to form a lower height yarn loop extending from the backing material. To "backrob," the yarn loop is first tufted and then pulled entirely from the face of the backing material. Some such loops are pulled entirely free of the backing, but others are left sufficiently embedded in the backing to "tack" the yarn in place on the backside of the backing. In this way, the backrobbed yarn loops are entirely invisible on the face side of the backing material.

A number of drawbacks result from the thread-up and tufting methodology taught by Hall. The implementation of pulling low or backrobbing results in a tufted product having a smaller amount of visible yarn on its face. To compensate for this, Hall teaches that the density of the yarn loops provided within a given length of the backing material must be increased. To achieve this, the machine must be operated at an increased or denser "stitch rate" (which Hall defines as the number of stitches per inch). Operation of the machine at a denser stitch rate slows the speed at which tufted fabric can be produced. For a given tufting bar reciprocation rate, the denser the stitch rate required, the slower the backing material can be fed through and tufted by the machine, and thus the slower the machine can be run.

This is only compounded by the number of different colors used to thread-up the machine. The more different colors used to form the pattern, the more the needle bar is required to shift and penetrate the backing material and the greater the distance the needle bar must shift to disperse the different colors across the backing material (i.e., to make each of the different colors "available" at all points across the width of the backing). Hall explains that the effective stitch rate run by its machine is a conventional stitch rate multiplied by the number of different colors used to form the pattern. Thus, the more colors used to form the pattern, the greater the effective stitch rate and the slower the machine can be run so as to attain the desired density of the yarn loops. With every additional color used to form the pattern, the speed of production is slowed until ultimately products made with the machine become commercially impractical. Furthermore, the more shifting that occurs, the more yarn that is used, thereby increasing the cost and weight of the product.

Moreover, the greater the stitch rate, the closer the penetrations made in the backing material along the length of the backing. The increased number and proximity of penetrations resulting from the introduction of each additional color into the thread-up can detrimentally impact the integrity of the backing material. In short, there is a limit to the number of different colors that can be used to form the pattern before the machine begins to tear up the backing and thus compromise the integrity of the final product.

SUMMARY

Embodiments of the present invention relate to methods of tufting a pattern in a backing material using a plurality of different yarns A, B, . . . n that are threaded in the needles of a needle bar in a non-repeating sequence or pattern of yarn sets across the width of the needle bar.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, and or all drawings and each claim.

BRIEF DESCRIPTION OF THE FIGURES

Illustrative embodiments of the present invention are described in detail below with reference to the following figures:

FIG. 1 illustrates a portion of a prior art thread-up.

FIG. 2 illustrates a portion of another prior art thread-up.

FIG. 3 illustrates a portion of a thread-up according to an embodiment of the present invention.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to methods of tufting a pattern in a carpet web using a plurality of different yarns A, B, . . . n. The yarns may be different in terms of type (e.g., single color, space dyed, barber pole, etc.) and/or color and/or texture.

A tufting machine such as that disclosed in Hall may be, but does not have to be, used to form the tufted carpet. Hall provides a detailed description of operation of such a machine and thus such a description is not provided here (except by incorporation by reference).

Each yarn A, B, . . . n is threaded in a needle of the needle bar. However, unlike in Hall, the yarns are not threaded in a repeating sequence or pattern across the entire width of the needle bar.

For purposes of illustration, assume that the Hall machine has been programmed to accommodate a three yarn system—different yarns A, B, and C. Using the Hall thread-up methodology, the same three yarns A, B, and C would be threaded in each set of three needles in the same order—ABC—as follows:

| Needle Position | Yarn Set |
|---|---|
| 1-3 | ABC |
| 4-6 | ABC |
| 7-9 | ABC |
| . . . | ABC |

Thus, the thread-up of the needle bar would be a repeating pattern or sequence of yarn set ABC across its width (i.e., ABCABCABC, etc.). FIG. 1 depicts such a thread-up.

Now assume that a pattern is desired to be formed with twelve (12) different yarns, requiring a twelve yarn system. Using the disclosed Hall thread-up methodology, the yarns A-L would be threaded in a repeating pattern across the width of the needle bar (A . . . L, A . . . L, etc.) (see FIG. 2), and the control system would be programmed to accommodate twelve different yarns. With this twelve yarn system, the needle bar would be required to shift great distances to disperse the twelve different yarns across the backing material and the effective stitch rate would increase. As a result, the number of required penetrations into the backing material to attain the effective stitch rate would increase. Moreover, the speed of production of the machine would likely have to be slowed to such an extent that the production of tufted products on a commercial scale would be impractical.

The following is an example of a thread-up according to one embodiment of the present invention that employs a twelve yarn system whereby twelve different yarns (yarns A-L) are positioned across the width of a needle bar. However, as opposed to programming the machine to accommodate a twelve yarn system, the Hall machine is still programmed to accommodate only a three yarn system, hence the grouping of the needles in sets of three. This illustrative thread-up is for only the first 200 needles on a needle bar. The entire thread-up would be repeated across the needle bar to accommodate needle bars having more than 200 needles.

| Needle Position | Yarn Set |
|---|---|
| 1-3 | AGJ |
| 4-6 | BFJ |
| 7-9 | BFI |
| 10-12 | BFI |
| 13-15 | AHI |
| 16-18 | BFI |
| 19-21 | BEI |
| 22-24 | CEK |
| 25-27 | DEL |
| 28-30 | BEL |
| 31-33 | AEL |
| 34-36 | AHJ |
| 37-39 | AHJ |
| 40-42 | AHJ |
| 43-45 | AGI |
| 46-48 | AGJ |
| 49-51 | BGL |
| 52-54 | AGI |
| 55-57 | CGI |
| 58-60 | CHI |
| 61-63 | AHI |
| 64-66 | CHK |
| 67-69 | DFK |
| 70-72 | CEK |
| 73-75 | DFK |
| 76-78 | CFK |
| 79-81 | CFL |
| 82-84 | CGL |
| 85-87 | CGL |
| 88-90 | DEL |
| 91-93 | BEI |
| 94-96 | DHI |
| 97-99 | DEI |
| 100-102 | DFI |
| 103-105 | DEI |
| 106-108 | DEL |
| 109-111 | CEL |
| 112-114 | BEL |
| 115-117 | DEI |
| 118-120 | BFK |
| 121-123 | BFK |
| 124-126 | BFK |
| 127-129 | BFK |
| 130-132 | BFJ |
| 133-135 | AGJ |
| 136-138 | BGJ |
| 139-141 | AGK |
| 142-144 | CFK |
| 145-147 | CHK |
| 148-150 | CGL |
| 151-153 | CEL |
| 154-156 | DHJ |
| 157-159 | CFL |
| 160-162 | DEK |
| 163-165 | CEJ |

-continued

| Needle Position | Yarn Set |
|---|---|
| 166-168 | DEL |
| 169-171 | AEI |
| 172-174 | AEI |
| 175-177 | DHL |
| 178-180 | DFL |
| 181-183 | BHJ |
| 184-186 | AFJ |
| 187-189 | AFJ |
| 190-192 | CHJ |
| 193-195 | AHK |
| 196-198 | AFK |
| 199-200 | BF |

FIG. 3 depicts a portion of this thread-up. In this disclosed thread-up, each set of three needles are threaded with a set of three yarns. The first set of three needles (needles 1-3) are threaded with yarns A, G, and J, respectively; the second set of three needles (needles 4-6) are threaded with yarns B, F, and J, respectively; etc. Unlike the thread-up methodology disclosed in Hall, different sets of yarns in this example contain different yarns or yarns arranged in different orders. In other words, the same yarns are not used in each yarn set and/or are not arranged in the same order within each yarn set. The result is that the thread-up pattern across the width of the needle bar is not a repeating pattern or sequence of the same yarn set. While some yarn sets may be the same, they do not repeat continuously across the needle bar. Other than the thread-up, the tufting machine can run substantially as disclosed in Hall.

During production, the machine will operate as if only three different yarns were being used. Thus, it will control shifting and penetration of the needle bar, calculate the effective stitch rate, and control production speed as if only three different yarns were employed. All the while, the machine will actually be tufting twelve different yarns to form the desired pattern.

By operating the machine as if a certain number of different yarns were being used (e.g., 3) but actually using more different yarns (e.g., 12), the associated benefits of reduced shifting and shifting time, reduced yarn use associated with reduced shifting, reduced effective stitch rate, fewer penetrations, and consequent faster production speed are realized. Thus, a greater variety of yarns may be used to form a pattern without the associated drawbacks of slower production time, increased face weight, and risk to backing integrity from over-penetration. In short, a commercially viable product can be made free from the diversity of color restrictions inherent in the Hall system.

The thread-up set forth above illustrates but one of an infinite number of thread-ups. Any number of different yarns may be used and positioned in any orientation across the needle bar (provided that the different yarns are not arranged in a repeating sequence across the width of the needle bar). Moreover, while the disclosed embodiment contemplates that the Hall machine would be programmed for a three yarn system, the Hall machine could be programmed to accommodate any number yarn system (a four yarn system whereby the needles would be grouped in sets of four and a yarn set would comprise four yarns, a five yarn system whereby needles would be grouped in sets of five and a yarn set would comprise five yarns, etc.).

Injecting more diversity of color across the carpet web without the associated drawbacks discussed herein may be achieved (1) if the thread-up includes more different colors than the machine is programmed to "believe" are being used and/or (2) if the different colors used are oriented in a non-repeating pattern or sequence of yarn sets across at least a portion of the width of the needle bar.

In some embodiments, a secondary backing is applied or attached to the underside of the tufted carpet web. While the tufted carpet web may be used as broadloom carpet, in some embodiments it is cut into carpet tiles.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

We claim:

1. A method of tufting a pattern in a backing material using a tufting machine comprising a needle bar having a width and comprising a plurality of needles oriented across the width of the bar, the method comprising:

a) providing a plurality of different yarns for tufting the pattern, wherein the plurality of different yarns comprises yarns A, B, . . . n;

b) threading at least some of the plurality of needles with one of each yarns A, B, . . . n to form a sequence of yarns across the width of the needle bar, wherein at least a portion of the sequence comprises some of yarns A, B, . . . n arranged in an order different from yarn A, yarn B, yarn C . . . yarn n;

c) tufting the backing material by:

i) moving the backing material under the needle bar in a direction, wherein the backing material comprises a face side and an underside and wherein feeding the backing material under the needle bar comprises feeding the backing material face side down under the needle bar;

ii) reciprocating the needle bar downwardly and upwardly to drive the needles at least partially through the backing material to force the yarn threaded on each needle to repeatedly penetrate through the backing material and thereby form yarn loops; and iii) controlling a tension on each yarn threaded on a needle to control the position of the yarn loops formed with each yarn relative to the backing material, wherein at least some of the yarn loops remain visible on the face side of the backing material and wherein at least some of the yarn loops are pulled at least partially out of the backing material so as not to be visible on the face side of the web.

2. The method of claim 1, further comprising grouping yarns A, B, . . . n into yarn sets, wherein each yarn set comprises less than all of yarns A, B, . . . n and wherein at least some yarn sets are different.

3. The method of claim 2, wherein threading at least some of the plurality of needles with one of yarns A, B, . . . n comprises threading sets of needles with the yarns of the yarn sets across the width of the needle bar, wherein the yarn set threaded on a first set of needles is different from the yarn set threaded on a set of needles adjacent the first set of needles.

4. The method of claim 2, wherein all of the yarn sets comprise a number of yarns and wherein the number of yarns in substantially all of the yarns sets is the same.

5. The method of claim 4, wherein tufting the backing material is controlled by a computer.

6. The method of claim 5, wherein the computer is programmed to tuft as if fewer than all of yarns A, B, . . . n were being used.

7. The method of claim 6, wherein the computer is programmed to tuft as if the number of different yarns being used were equal to the number of yarns in substantially all of the yarns sets.

8. The method of claim 1, further comprising shifting the needle bar laterally relative to the direction of movement of the backing material.

9. The method of claim 1, further comprising cutting the backing material into carpet tiles after tufting.

10. The method of claim 1, further comprising applying a secondary backing to the backing material after tufting.

11. A method of tufting a pattern in a backing material using a tufting machine comprising a needle bar having a width and comprising a plurality of needles oriented across the width of the bar, the method comprising:

a) providing a plurality of different yarns for tufting the pattern, wherein the plurality of different yarns comprises yarns A, B, . . . n;

b) grouping yarns A, B, . . . n into yarn sets, wherein each yarn set comprises less than all of yarns A, B, . . . n, and wherein at least some yarn sets are different;

c) threading sets of needles with the yarns of the yarn sets across the width of the needle bar, wherein the yarn set threaded on a first set of needles is different from the yarn set threaded on a set of needles adjacent the first set of needles;

d) tufting the backing material by:

i) moving the backing material under the needle bar in a direction, wherein the backing material comprises a face side and an underside and wherein feeding the backing material under the needle bar comprises feeding the backing material face side down under the needle bar;

ii) reciprocating the needle bar downwardly and upwardly to drive the needles at least partially through the backing material to force the yarn threaded on each needle to repeatedly penetrate through the backing material and thereby form yarn loops; and iii) controlling a tension on each yarn threaded on a needle to control the position of the yarn loops formed with each yarn relative to the backing material, wherein at least some of the yarn loops remain visible on the face side of the backing material and wherein at least some of the yarn loops are pulled at least partially out of the backing material so as not to be visible on the face side of the web.

12. The method of claim 11, wherein tufting the backing material is controlled by a computer.

13. The method of claim 12, wherein the computer is programmed to tuft as if fewer than all of yarns A, B, . . . n were being used.

14. The method of claim 11, further comprising shifting the needle bar laterally relative to the direction of movement of the backing material.

15. The method of claim 11, further comprising cutting the backing material into carpet tiles after tufting.

16. The method of claim 11, further comprising applying a secondary backing to the backing material after tufting.

* * * * *

UNITED STATES PATENT AND TRADEMARK OFFICE

CERTIFICATE OF CORRECTION

PATENT NO. : 8,347,800 B1
APPLICATION NO. : 13/190635
DATED : January 8, 2013
INVENTOR(S) : Carson Rebecca Machell-Archer et al.

It is certified that error appears in the above-identified patent and that said Letters Patent is hereby corrected as shown below:

In the claims

In Claim 1, Col. 6, line 59, delete “web” and insert --backing material-- therefor.

In Claim 11, Col. 8, line 20, delete “web” and insert --backing material-- therefor.

Signed and Sealed this
Twentieth Day of October, 2015

Michelle K. Lee

Michelle K. Lee
*Director of the United States Patent and Trademark Office*